US005601100A

United States Patent [19]

Kawakami et al.

[11] Patent Number: 5,601,100

[45] Date of Patent: Feb. 11, 1997

[54] WASHING APPARATUS

[75] Inventors: Kunihiko Kawakami; Yasunori Kurahashi; Takao Morisaki; Osamu Monma; Seiji Sato; Akihiro Hayashi; Hideho Taguchi; Keiji Kameishi; Naoto Minamikawa; Koji Ogawa; Masanori Kato; Hirotaka Abou, all of Nakatsugawa, Japan

[73] Assignee: Mitsubishi Denki Kabushiki Kaisha, Tokyo, Japan

[21] Appl. No.: 329,274

[22] Filed: Oct. 26, 1994

[30] Foreign Application Priority Data

| | | | |
|---|---|---|---|
| Oct. 28, 1993 | [JP] | Japan | 5-270201 |
| Apr. 4, 1994 | [JP] | Japan | 6-065353 |
| Apr. 4, 1994 | [JP] | Japan | 6-065354 |
| Apr. 4, 1994 | [JP] | Japan | 6-065355 |
| Apr. 5, 1994 | [JP] | Japan | 6-066972 |

[51] Int. Cl.[6] ..... B08B 3/02

[52] U.S. Cl. ..... 134/56 R; 134/95.2; 134/95.3; 134/99.1; 134/103.2; 134/199

[58] Field of Search ..... 134/56 R, 56 D, 134/57 R, 57 D, 50, 88, 90, 95.2, 95.3, 99.1, 102.3, 103.2, 107, 198, 199

[56] References Cited

U.S. PATENT DOCUMENTS

| | | | |
|---|---|---|---|
| 908,509 | 1/1909 | Silverglade | 134/199 |
| 2,191,799 | 2/1940 | McKenna | 134/199 X |
| 2,294,668 | 9/1942 | Karas | 134/199 X |
| 2,596,653 | 5/1952 | Clague et al. | 134/199 |
| 2,666,439 | 1/1954 | Bechtol | 134/199 X |
| 3,060,944 | 10/1962 | Brollo | 134/107 X |
| 3,401,705 | 9/1968 | Goldware | 134/199 X |
| 3,858,595 | 1/1975 | Schultz et al. . | |
| 3,918,987 | 11/1975 | Kopfer | 134/95.2 |
| 4,552,163 | 11/1985 | Biancalana et al. | 134/102.3 |
| 4,938,933 | 7/1990 | Perrot | 134/199 X |
| 5,259,406 | 11/1993 | Hofmann | 134/95.2 X |
| 5,265,628 | 11/1993 | Sage et al. | 134/95.3 X |

FOREIGN PATENT DOCUMENTS

| | | |
|---|---|---|
| 0282239 | 9/1988 | European Pat. Off. . |
| 0527567 | 2/1993 | European Pat. Off. . |
| 2657276 | 7/1991 | France . |
| 8400262 | 8/1985 | Netherlands . |
| 559542 | 3/1975 | Switzerland . |
| 316031 | 8/1928 | United Kingdom . |

*Primary Examiner*—Philip R. Coe

[57] ABSTRACT

To obtain a washing machine capable of sanitarily effecting washing with fresh water at all times and reducing a washing time and a drying time. Tap water supplied from a water feed pipe in association with sensing means is pressurized to predetermined pressure by a pressurizing pump, supplied to water injection nozzle pipes and injected into a washing space through water injection nozzles. The user inserts tableware held by hands between the nozzles, energising the sensor mechanism. A high speed water flow injected from the nozzles collides against the tableware and washes the tableware by removing stubborn dirt from the tableware. On the other hand, an air flow from a blower passes though the air nozzle pipes and is discharged from the air nozzles to remove the drops of water attached to the tableware by forced air action.

28 Claims, 13 Drawing Sheets

| | WASHING | DRYING |
|---|---|---|
| WASHING SENSOR (15A) | WASHING | DRYING |
| HOLDING SENSOR (15B) | WASHING | DRYING |
| DRYING SENSOR (16A) | DRYING | DRYING |
| HOLDING SENSOR (16B) | WASHING | DRYING |

PRIOR ART

WASHING APPARATUS

BACKGROUND OF THE INVENTION

The present invention relates to a washing apparatus for washing tableware, foods and the like by a water injection flow and, more particularly, to a washing apparatus permitting an easy washing operation during cooking or after meals.

FIG. 18 is a longitudinal cross sectional view showing a tableware washing apparatus disclosed in, for example, Japanese Utility Model Publication No. 55-34041.

In the figure, reference numeral 1 denotes a washing apparatus main body, numeral 2 denotes a water supply valve disposed above the main body 1, numeral 3 denotes an inner vessel disposed in the main body 1, numeral 4 denotes a nozzle bearing fixed on the bottom surface of the inner vessel 3, numeral 5 denotes a water injection nozzle rotatably supported by the nozzle bearing 4, numeral 6 denotes a tower nozzle fixed at the center of the water injection nozzle 5, numeral 7 denotes a lower basket disposed just above the water injection nozzle 5 and supported by the side wall of the inner vessel 3 to accommodate tableware 8, and numeral 9 denotes an upper basket disposed above the tower nozzle 6 and supported by the side wall of the inner vessel 3 to accommodate the tableware 8.

Reference numeral 10 denotes a recessed portion formed to a portion of the bottom surface of the inner vessel 3 and provided with a waste food filter 11, numeral 12 denotes a pump having a suction port connected to the recessed portion 10 through a suction pipe 13 and a discharge port connected to the bearing 4 through a discharge pipe 14, and numeral 15 denotes a drain pipe connected to the bottom of the recessed portion 10 and piped to the outside of the washing apparatus main body 1.

In the conventional tableware washing apparatus arranged as described above, the tableware 8 are accommodated in the lower basket 7 and the upper basket 9 and set in the inner vessel 3. Thereafter, tap water supplied to the inner vessel 3 by opening the water feed valve 2 is mixed with detergent and the pump 12 is driven. The washing water sucked by the pump 12 is discharged through the discharge pipe 14 and jetted upward from the water injection nozzle 5 and washes the tableware 8 in the lower basket 7 while being rotated by the reaction of the injection action. In the same way, the tower nozzle 6 also rotates while jetting washing water and washes the tableware 8 in the upper basket 9.

The washing water by which the tableware 8 are washed as described above falls in the inner vessel 3 and flows into the recessed portion 10. Then, the washing water is cleaned by the waste food filter 11, sucked into the pump 12 and supplied again to the water injection nozzle 5 and the tower nozzle 6 from the discharge pipe 14 so that the washing water is repeatedly recycled to conduct the washing operation. When washing by the detergent is finished, the dirty water is drained through the drain pipe 15.

Thereafter, the fresh water is supplied again from the water feed valve 2 and injected from the water injection nozzle 5 and the tower nozzle 6 to rinse the tableware 8 in the same manner as the washing operation. When the rinse operation is finished, the water is drained again. Finally, the tableware 8 are dried by air supplied from a blower (not shown).

Since the conventional tableware washing apparatus as described above washes the tableware 8 accommodated in the baskets 7 and 9 by jetting washing water discharged from the pump 12, the washing apparatus has the following problems:

(1) Washing operation is troublesome.

a. The tableware 8 must be carefully set one by one in the baskets 7 and 9 in order to ensure that the tableware 8 can be easily washed; and b. Since the tableware 8 are washed by water stored in the inner vessel 3, when the tableware 8 is very dirty or heavily soiled, the washing water is made increasingly dirty and washing cannot help being imperfect, and thus very dirty portions must be prewashed and removed before the tableware 8 is washed by the tableware washing apparatus to cope with this problem.

(2) Washing cannot be effected with a strong water flow:

a. Since the tableware 8 are simply placed in the baskets 7 and 9, when the washing water is strongly injected, the tableware 8 are shaken and collide against each other in the baskets 7 and 9 and there is a possibility that the tableware 8 are broken. That is, it is contemplated that the washing water used in the conventional tableware washing apparatus suitably has a water injection pressure of about 0.5 kg/cm2 and a pressure less than 1 kg/cm2 is used at the maximum. Therefore, since the washing cannot be effected with a strong water flow, specially dedicated strong detergent is indispensable to promote washing. Further, there is a problem that a water flow cannot be adjusted.

(3) Washing operation is time-consuming.

Not only the setting of the tableware 8 itself is troublesome and time-consuming as described above in the item 1 but also washing water must be heated by a heater to improve the washing effect. Thus, the heating time, washing time, washing water purging time and rinsing time are needed, which results in a problem that many processes are necessary.

(4) Washing cannot be effected with fresh water. When washing is effected while dirty or polluted washing water is replaced with fresh water, the temperature of the washing water is lowered as well as the concentration of detergent is inevitable reduced.

(5) Only the batch washing (washing is effected only when some amount of tableware are collected.) is possible:

a. Since an amount of washing water and a washing period of time are fixedly determined regardless of the number of the tableware 8, when the smaller number of the tableware 8 are to be washed, the efficiency of the use of the tableware washing apparatus is low.

b. When batch washing is effected, dirt or soil on the tableware is dried or solidified while the tableware are stored, and thus it is difficult to remove the dirt.

(6) A function for sensing tableware is not provided.

Since the washing apparatus can be operated regardless of the presence or absence of the tableware 8 in the baskets 7 and 9, there is a possibility that the washing apparatus is operated without load.

(7) Object to be washed is limited.

Since detergent is mixed into a high-temperature water for washing, vegetables and tableware made such as of Japanese lacquer or silver cannot be washed.

SUMMARY OF THE INVENTION

Accordingly, one object of the present invention is to provide a washing apparatus free from the above-discussed problems of the conventional design.

Another object of the present invention is to provide a washing apparatus in which a widened range of objects to be washed can be easily and quickly washed during cooking and after meals.

Still another object of the present invention is to provide a washing apparatus in which the washing can be achieved without the use of detergent or with only a small amount of detergent.

Yet another object of the present invention is to provide a washing apparatus in which, when the tableware or the like are to be separately washed, the washing operation can be continuously conducted without being interrupted.

A further object of the present invention is to provide a washing apparatus in which the temperature of the washing water can be suitably regulated to improve the washing capability.

Another object of the present invention is to provide a washing apparatus in which the washing operation can be easily performed by the user.

Still another object of the present invention is to provide a washing apparatus in which not only the washing of the tableware or the like can be conducted, but also the washed tableware or the like can be air dried to more completely achieve the washing operation.

Another object of the present invention is to provide a washing apparatus in which the time for drying the remaining moisture on the tableware or the like is shortened.

Another object of the present invention is to provide a washing apparatus which is improved in its hygiene condition and is easy in washing and drying operations.

Another object of the present invention is to provide a washing apparatus in which water is prevented from escaping from the washing apparatus, through the opening, and splashing on the user.

With the above objects in view, the present invention resides in a washing apparatus which comprises a main body defining therein a washing space, a main body opening provided in the main body in communication with said washing space for moving therethrough an object to be washed into and out of said washing space, a water injection nozzle for injecting water into the washing space, a water pressurizing pump connected to the water injection nozzle for pressurizing water, and a water source connected to the water pressuring pump for supplying water to the pressure pump, wherein water is injected from the water injection nozzle with the main body opening opened.

The washing apparatus of the present invention may further comprise means, including a sensor for detecting the object to be washed within the washing space, for initiating the injection of water from the injection nozzle when the object to be washed is detected and terminating the injection of water from the injection nozzle when within the washing space, for initiating the injection of water from the injection nozzle when the non-presence of the object to be washed and for terminating the injection of water from the injection nozzle after a predetermined time lag from the detection of the non-presence of the object to be washed.

The washing apparatus may further comprise means, connected between the water source and the injection nozzle, for changing temperature of the water.

The washing apparatus may further comprise means for adjusting an injection angle or pressure of water injection injected from the injection nozzle.

The washing apparatus may further comprise an air nozzle for expelling air into the washing space and a blower for supplying air to the air nozzle.

The washing apparatus may be arranged such that the air nozzle comprises a number of air nozzles each injecting air into different directions.

The washing apparatus may be arranged such that each air nozzle includes holes for injecting air in radial directions.

The washing apparatus may be arranged such that the air nozzle is detachably mounted.

The washing apparatus may further comprise locking means for preventing water from being injected from the injection nozzle when an air flow is generated from the air nozzle.

The washing apparatus of the present invention may further comprise a washing sensor for detecting the object to be washed presented within the washing space to inject water from the injection nozzle and a drying sensor for detecting the object to be washed presented within the washing space to generate a flow of air from the air nozzle, the washing sensor being positioned in front of the opening and the drying sensor being positioned to the rear of the washing sensor.

The washing apparatus may be arranged such that the injection nozzle comprises a number of injection nozzles each injecting water in different directions.

The washing apparatus may further comprise a lid cover detachably mounted to the main body for enabling access to the opening.

The washing apparatus of the present invention may comprise a main body having an opening provided in the upper portion thereof for allowing an object to be washed to be moved therethrough into and out of the main body, an outer vessel defining therein a washing space communicated with the opening, an inner vessel disposed within the outer vessel with a space formed therebetween and having at its bottom wall an opening communicated with the space between the inner and outer vessels, a water injection nozzle disposed to the inner or outer vessel for injecting water into the washing space, a water pressure pump connected to the water injection nozzle for pressurizing water, and a source of water for supplying water to the water pressure pump, wherein water is injected from the water injection nozzle with the main body opening opened.

The washing apparatus may further comprise a fin inwardly projecting from the inner surface of the inner tank.

The washing apparatus may further comprise an auxiliary water injection nozzle disposed above the water injection nozzle for injecting water at a pressure lower than that of the water injected from the water injection nozzle.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
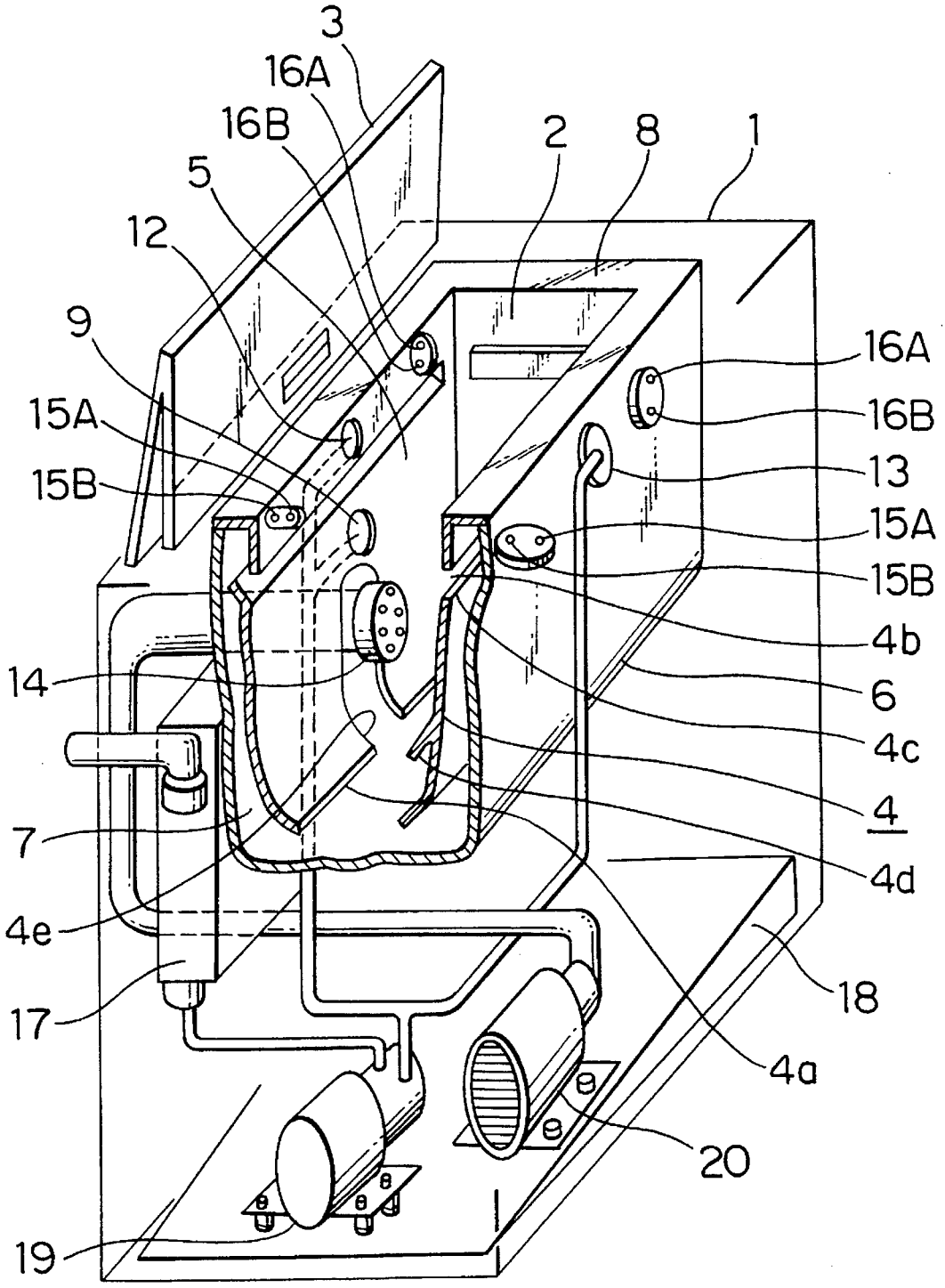
FIG. 1 is an inside perspective view of a tableware washing apparatus showing an embodiment of the present invention.

In FIG. 1 to FIG. 7, reference numeral 1 denotes the main body of the tableware washing apparatus, numeral 2 denotes an opening formed on the upper portion of the main body 1, numeral 3 denotes a folding type lid having an edge detachably attached to the upper portion of the main body 1 enabling access to the opening 2, numeral 4 denotes an inner vessel accommodated in the main body 1 and having a washing space 5 formed therein, numeral 6 denotes an outer vessel formed to the outside of the inner vessel 4 with a space for a water mist path 7 defined between the inside vessel 4 and the outside vessel 6. Curved portions *6a* are formed to the bottom corners of the outside vessel.

The inside vessel 4 includes a suction port *4a* formed to the bottom thereof and communicating with the water mist flow path 7 and a window hole *4b* as a blow off port defined to the inner wall thereof and the window hole *4b* has a flow regulating plate *4c* inclining downward. Further, a downwardly inclining fin *4d* projects from one side of the inner wall of the inside vessel 4 and a notch *4e* is defined to the other side of the inner wall and an air injection nozzle 14 to be described below loosely passes through the notch. Numeral 8 denotes an upper plate for closing the upper edges of the inside vessel 4 and the outside vessel 6 as well as forming the opening 2.

Numeral 9 denotes a main nozzle attached to one side of the inner surface of the outside vessel 6 for jetting washing water 11 in a water film state to tableware 10 held by hands into the washing space 5 through the hole defined to the inside vessel 4. Numeral 12 denotes a similar auxiliary nozzle disposed above the main nozzle 9, numeral 13 denotes a cup rim nozzle attached to the other side of the inner surface of the outside vessel 6 in confrontation with the main nozzle 9 and the auxiliary nozzle 12, numeral 14 denotes an air injection nozzle projecting into the washing space 5 through the notch *4e* of the inside vessel 4 for water removal.

Reference numerals 15A denote washing operation sensors disposed to the outside vessel 6 for emitting and receiving a light passing across the inside vessel 4 to sense an object obstructing that light, numerals 15B denote holding sensors disposed on the user's side in the vicinity of the washing operation sensor 15A, and reference numerals 16A denote water removing or drying sensors, and numerals 16B denote holding sensors disposed on the user's side in the vicinity of the drying sensor 16A. The washing operation sensors 15A are disposed near to one side of opening 2 in the longitudinal direction thereof and the drying sensors 16A are disposed to the opposite side of the washing operation sensor 15A, i.e., near to the other side of the opening 2 in the longitudinal direction thereof. Therefore, the holding sensor 16B is positioned between the washing operation sensors 15A and the drying sensor 16A. When the washing operation sensor 15A detects an object, it actuates the pressurizing pump 19 for a predetermined time interval such as a few seconds. When the drying sensor 16A detects an object, it actuates the blower 20 for a predetermined time interval such as 1 second.

When the holding sensors 15B, 16B sense an object in the washing space while the corresponding washing operation sensor 15A or the drying sensor 16A causes the pressurizing pump 19 or the blower 20 to be operated, the holding sensors keep the operating state (washing or moisture drying) by the corresponding sensors, respectively, for a predetermined time such as a few seconds. Reference numeral 17 denotes a water storage tank disposed in the main body 1 for storing fresh water from a tap water pipe or the like, the tank having an irregularly formed wave regulator (not shown) defined on the inner wall thereof for suppressing the swell of water. Numeral 18 denotes a base disposed on the bottom of the main body 1 and inclining downward with respect to the front side of the main body 1, numeral 19 denotes a pressurizing pump disposed on the base 18 and having a suction side connected through a piping to the water storage tank 17 and a discharge side connected through a piping to the respective nozzles 9, 12, 13, and numeral 20 denotes a blower disposed on the base 18 and having a discharge side connected through a hose to the air injection nozzle 14 for supplying air under pressure.

The pressure at which washing water from the water pressurizing pump 19 can remove the dirt or spil attached to the tableware is from about 2 kg/cm2 to 20 kg/cm2. With this value, the fresh water exhibits a sufficient washing effect, no pain is felt even if the water is injected on hands, and washing operation can be finished within 3 to 5 seconds per piece of tableware. The amount of flow rate of water necessary for washing is generally less than the amount of flow rate of water which can be supplied from a tap water supply (20 liters/min. or less). If a large water flow rate is needed for washing, the water storage tank 17 having a large capacity is required to secure the amount of water, which results in an increase of overall size of the washing apparatus. However, since the aforesaid necessary amount of water is within the amount of water capable of being supplied from the tap water supply, washing can be continuously effected because there is no limit in an amount of water. Therefore, the water storage tank 17 may only have a minimum capacity.

Also, the air pressure that is needed for removing the washing water 11 that reins attached to the tableware or the like 10 is of the order of from 100 $mmH_2O$ to 500 $mmH_2O$, the pressure of the air to be injected from the air nozzle 14 can be suitably determined within this range.

Figure 12:
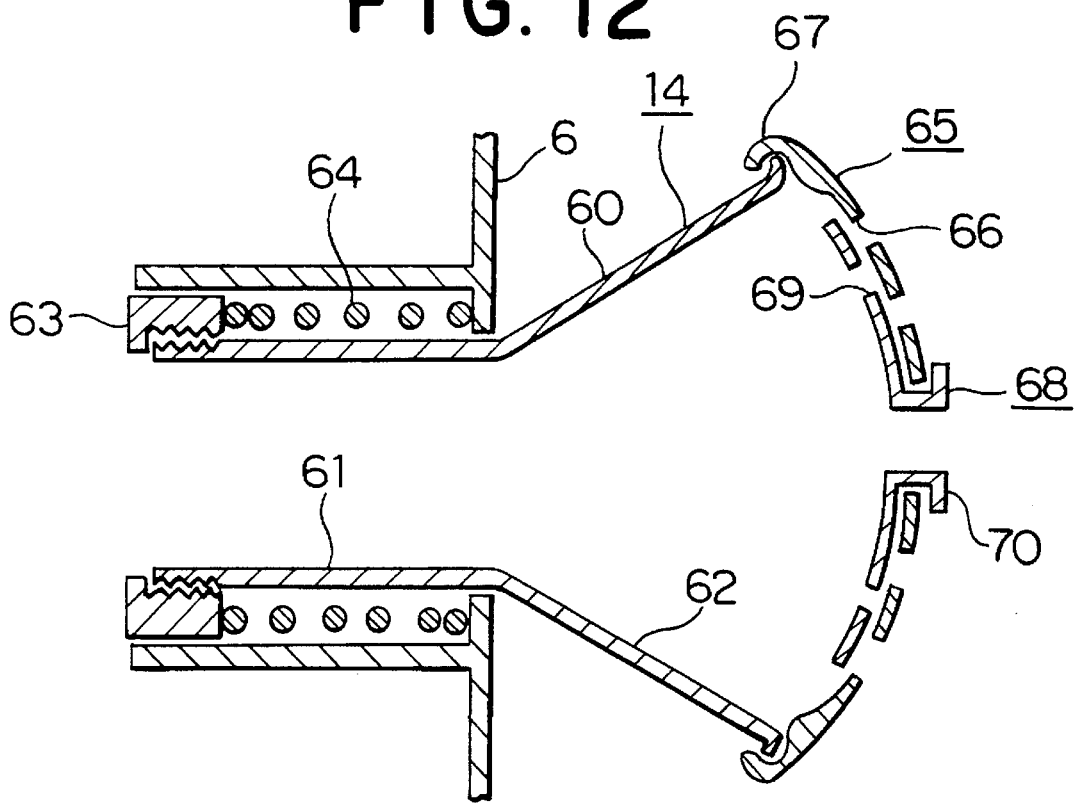
FIG. 12 is an enlarged schematic sectional view of the air nozzle.

FIG. 12 illustrates an enlarged sectional view of the air nozzle 14, wherein reference numeral 60 denotes a nozzle member constituting the air injection nozzle 14 and including a cylindrical portion 61 inserted into the outside vessel 6 and a trumpet-shaped portion 62 projecting to the washing space 5 side with a spring receiver 63 screwed into the extreme end of the cylindrical portion 61. Numeral 64 denotes a compressed spring coil disposed between the spring receiver 63 and the outside vessel 6.

Reference numeral 65 denotes a head portion for covering the opening of the trumpet-shaped portion 62 of the nozzle member 14. The head portion 65 is formed to have a hemispherical surface, has a plurality of nozzle holes 66 and is engaged to the opening edge of the trumpet-shaped portion 62 by means of the claws 67 formed on the circumferential edge of the head portion 65. Therefore, the head portion 65 is detachably attached by claw-engagement structure to the air nozzle 14, so that the cleaning of the head of the air nozzle is easy. Numeral 68 denotes a flow regulating plate rotatably supported to the inside of the head portion 65. The flow regulating plate 68 has flow regulating holes 69 overlapping with the nozzle holes 66 and a central portion projecting from the head portion 65 to form a knob 70.

In FIG. 8 to FIG. 11, reference numeral 25 denotes a control unit having a manually operated washing switch 26 and a manually operated moisture drying switch 27 and connected to the respective sensors 15A, 15B, 16A, 16B and a washing mechanism 28 and a moisture drying mechanism 29. The washing mechanism 28 is mainly composed of the pressurizing pump 19 and the moisture drying mechanism 29 is mainly composed of the blower 20.

The manually operating washing switch 26 and the manually operating moisture drying switch 27 are suitably operated by an operator through a switch (not shown) disposed on the surface of the main body of the washing apparatus.

Next, overall operation of this embodiment will now be described.

When the washing apparatus is not in use, the opening 2 is closed by the lid 3 so that the tableware 10 is prevented from being dropped into the washing space 5 and that the working space in a kitchen can be enlarged. When the washing apparatus is in use, the lid 3 is opened, folded to two portions and made to stand as shown in FIG. 1 to prevent the scatter of water splash which collides against the tableware 10 and splashes during washing. Note, when the lid 3 is further brought down outward from the position shown in FIG. 1, cleaning can be easily effected. When the lid 3 is detached from the main body 1, the space available for the washing operation can be made larger, making cleaning easier.

In initiating washing, the tableware 10 or the like is loaded by holding it by hands within the washing space 5 from the opening 2 opened with the lid 3 removed. First, when the tableware 10 or the like is inserted into the washing space 5 from the front side of the opening 2 and a sensing light beam of the washing operation sensors 15A is interrupted by the tableware 10 or the like, the washing operation sensor 15A is operated to drive the pressurizing pump 19. Thus, the water is pressurized to a pressure capable of removing the dirt and soil attached to the tableware 10 or the like and injected from the main nozzle 9, the auxiliary nozzle 12 and the cup rim nozzle 13.

Figure 4:
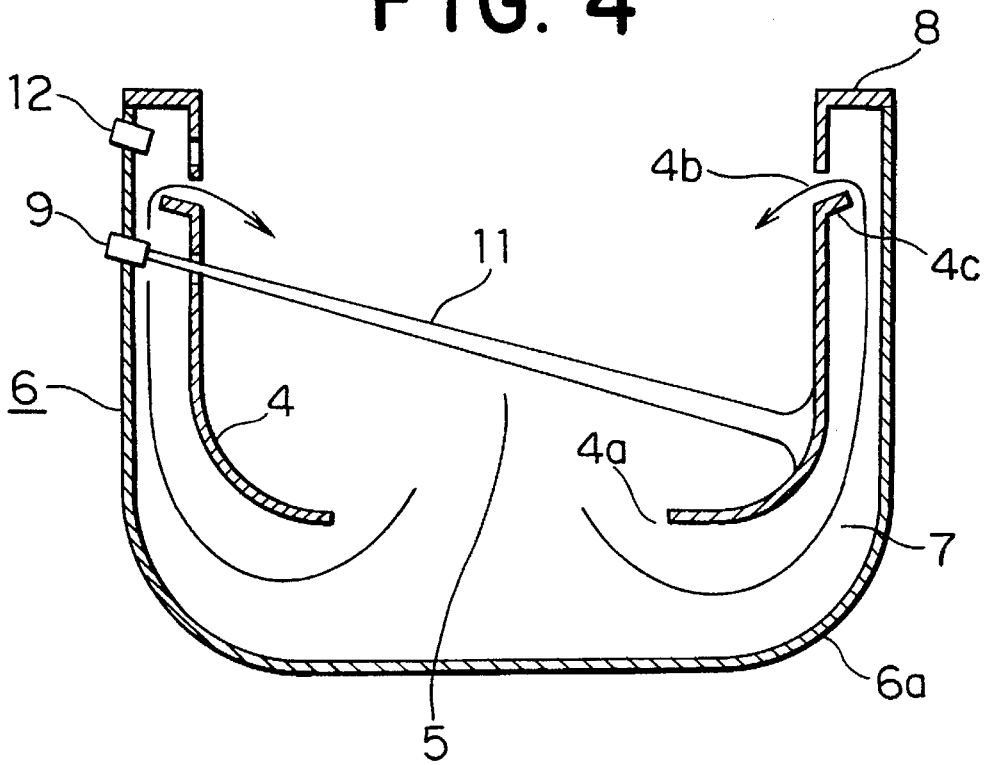
FIG. 4 is a longitudinal cross sectional view of the inner vessel and the outer vessel for showing the circulation of an atomized water flow according to an embodiment of the present invention.
Figure 5:
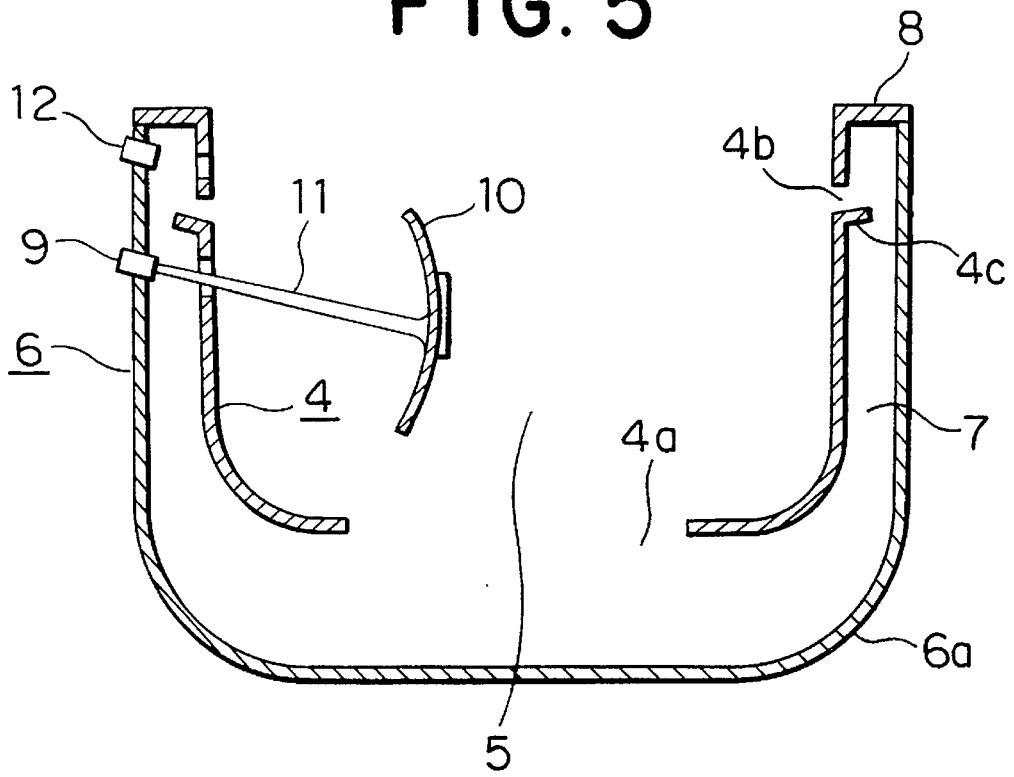
FIG. 5 is a longitudinal cross sectional view of the inside vessel and the outside vessel for showing a washing state according to an embodiment of the present invention.

As shown in FIG. 4 and FIG. 5, a portion of the water 11 from the main nozzle 9 collides against the tableware 10 or the like and the inner vessel 4 to become water mist. The water mist is introduced to the suction port 4*a* by the kinetic energy of the water 11. At this time, since the flow path of the suction port 4*a* has an area set larger than that of the other flow path portion as well as the curved portions 6*a* are formed to the corners of the outside vessel 6, the water mist is effectively collected. The thus collected water mist rises along the water mist flow path 7, is subjected to a flow regulation by the flow regulating plate 4*c* in the window hole 4*b* disposed above the location where the water 11 collides against the tableware 10 and stably injected into the washing space 5.

As a result, the water mist produced in the washing space 5 is stably introduced from the washing space 5 into the water mist flow path 7 and deposited on the wall surface of the water mist flow path 7 so that only an air flow circulates and the outflow of the water mist to the outside of the washing space 5 is reduced. Since the fin 4*d* is positioned above the location where the water 11 collides against the inside vessel 4, the splash of the water scattered by the collision is suppressed. Although the window hole 4*b* is defined at the upper portion of the inside vessel 4, a window hole communicating with the water mist flow path 7 may be additionally defined to the inner wall of the inside vessel 4 to enable the scattered water to escape to the water mist flow path 7.

Figure 6:
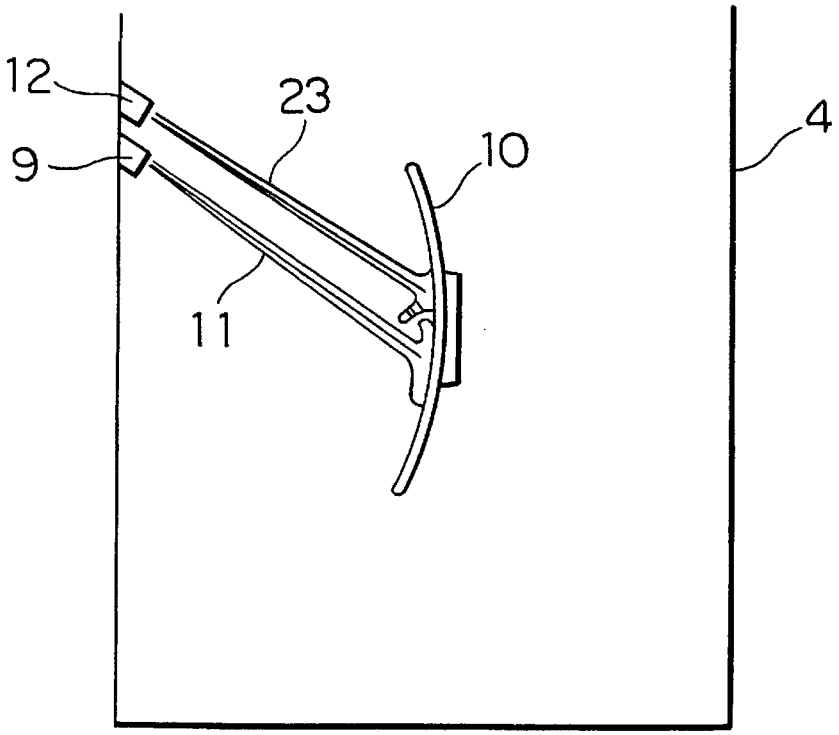
FIG. 6 is a view explaining the operation of a main nozzle and an auxiliary nozzle according to an embodiment of the present invention.
Figure 7:
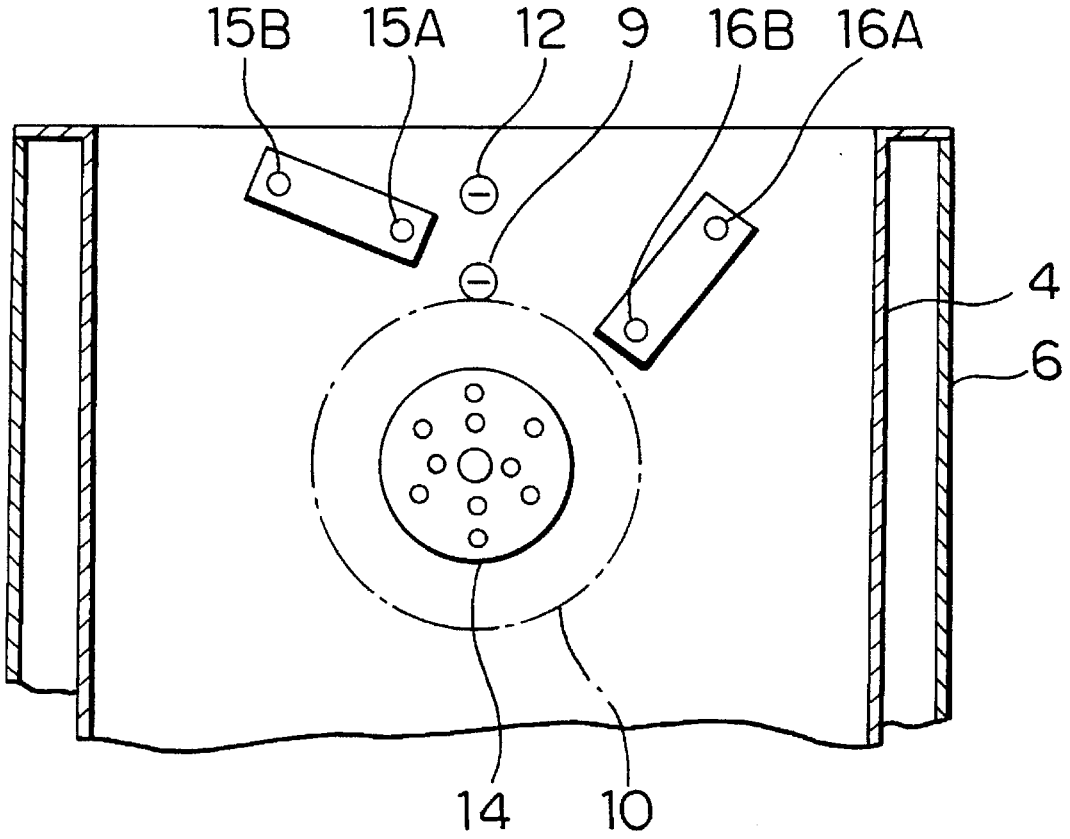
FIG. 7 is a longitudinal cross sectional view of FIG. 1 for explaining the disposition of respective sensors.
Figure 8:
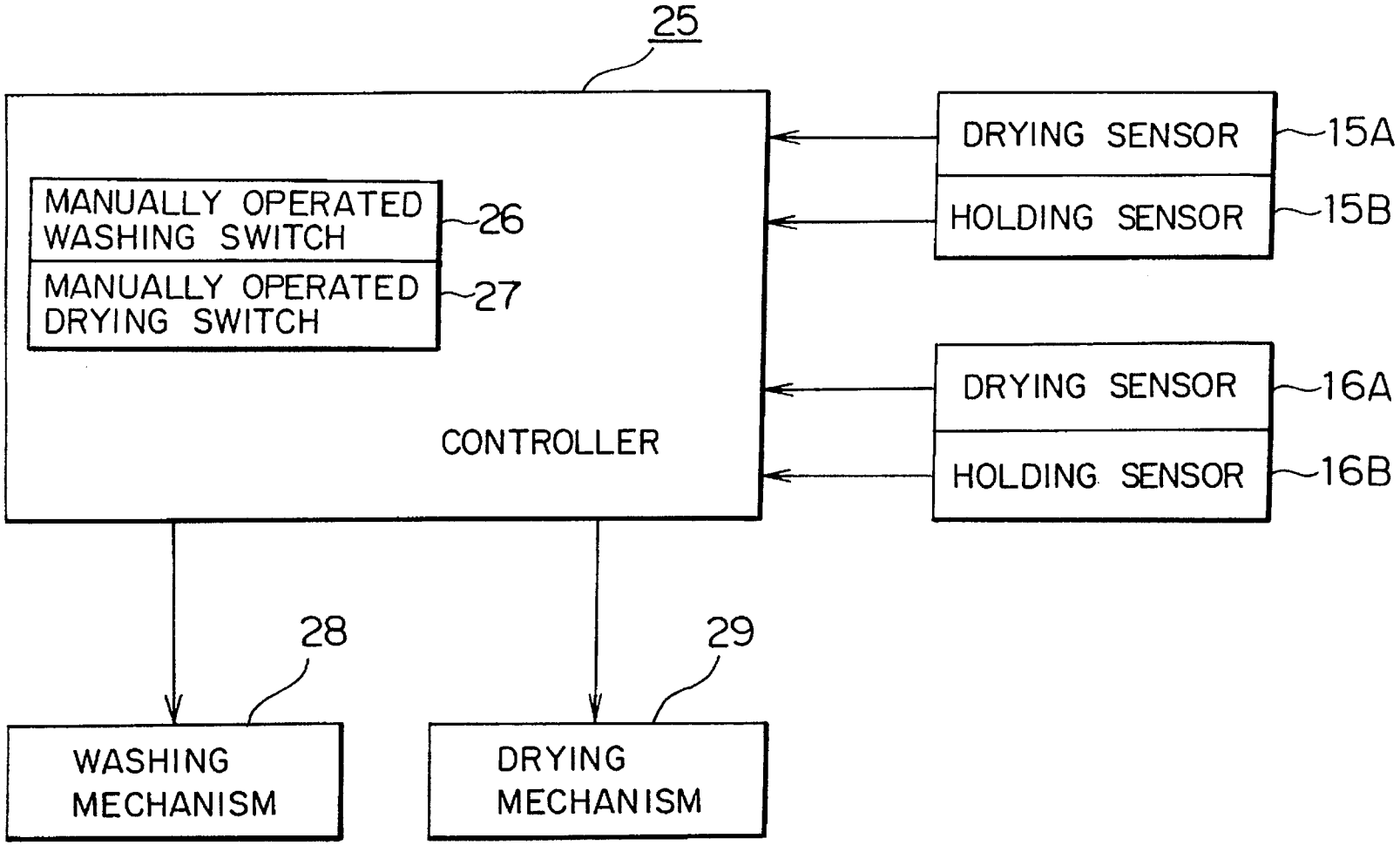
FIG. 8 is a block diagram showing the arrangement of a control unit according to an embodiment of the present invention.

Each of the auxiliary nozzle 12 and the cup rim nozzle 13 injects a water injection flow having a pressure lower than that of the water injection flow from the main nozzle 9 by means of an orifice 99 (shown in FIG. 15) positioned between each of them and the pressurizing pump 19. Since the water injection flow 23 from the auxiliary nozzle 12 is positioned above the high pressure water 11 from the main nozzle 9 as shown in FIG. 6 and the water 11 from the main nozzle 9 is at a high pressure and has a larger kinetic energy, the water, which collides against the tableware 10 or the like and is about to scatter, is obstructed so that the scattering of the water from the opening 2 to the outside is prevented.

Figure 15A:
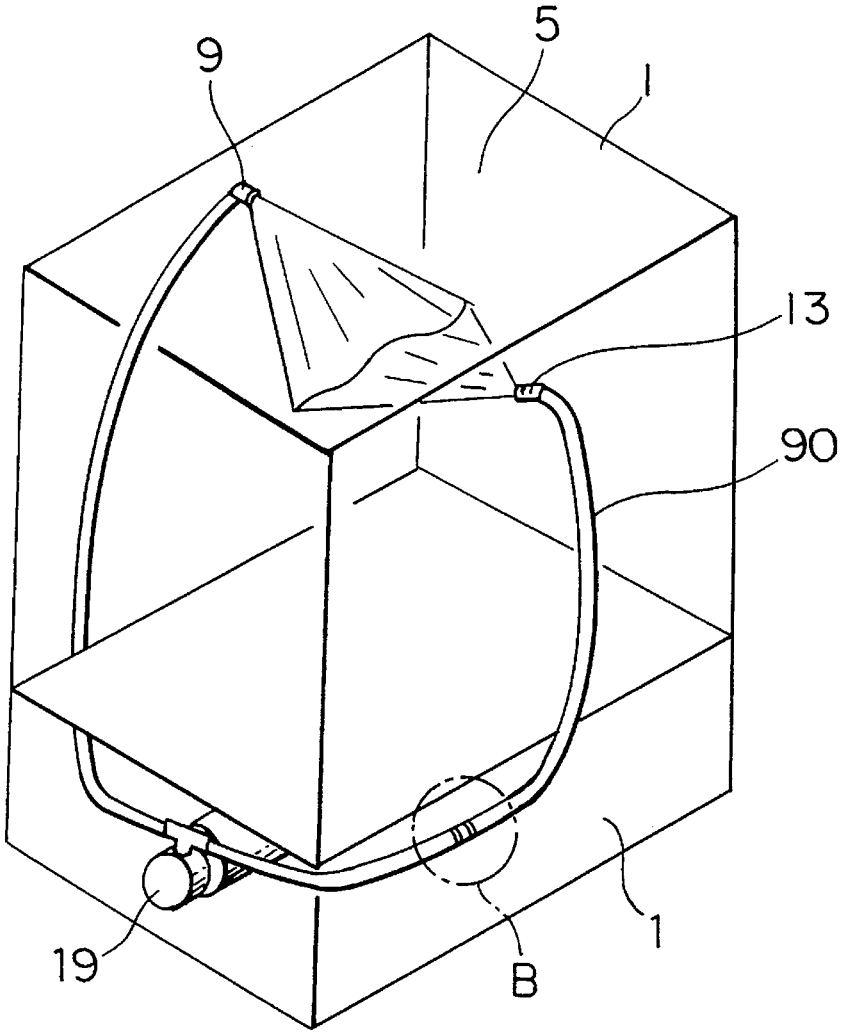
FIG. 15A is a schematic perspective view of the washing apparatus having an orifice within the pipe.
Figure 15B:
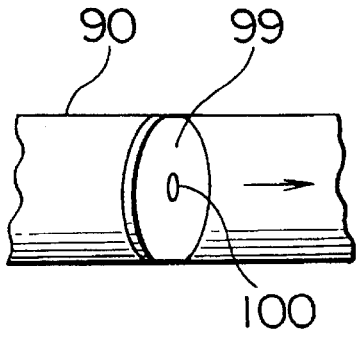
FIG. 15B is an enlarged schematic diagram illustrating the orifice disposed within the pipe.

FIG. 15A and FIG. 15B illustrate an arrangement for injecting the water 11 at different pressures from the respective nozzles for injecting the water 11. More specifically, within the pipe 90 between the cup rim nozzle 13 or the auxiliary nozzle 12 and the pressurizing pump 19, an orifice 99 is provided. The circular orifice 99 has at its center a bore 100 of a small diameter so that the water 11 that passes through the pipe 90 is reduced, thereby making the pressure of the water 11 injected from the cup-rim nozzle 13 on the right side in FIG. 15A lower than the pressure of the water 11 injected from the left-side main nozzle 9. This prevents waste of the water 11, and the generation of two different pressures by a single pressurizing pump.

FIG. 15B illustrates a portion B shown in FIG. 15A in enlarged view.

At the same time, the water injection flow 23 from the auxiliary nozzle 12 collides against the tableware 10 above the water 11 from the main nozzle 9 and the water injection flow 23 having lost its energy drops downward. Although the water 11 from the main nozzle 9 collides against the tableware 10 and splashes, the scatter of the water from the opening 2 to the outside is prevented by the dropping water flow.

Further, with respect to cups, the insides of them are washed by the main nozzle 9 and at the same time the cup rims thereof can be washed by the water from the cup rim nozzle 13. At this time, the water from the cup rim nozzle 13 has a pressure reduced to a degree at which the water is not splashed by collision.

When the tableware 10 which has been washed as described above is moved horizontally while being held and obstructs the light from the water removing operation sensor 16A, the water drying operation sensor 16A is put into operation so that the moisture drying mechanism 29 is operated to drive the blower 20. With this operation, the blower 20 supplies air under pressure and air is blown from the air injection nozzle 14 so that the drops of water attached to the tableware 10 are removed to dry the tableware 10, whereby a washing and drying job is finished.

Figure 9:
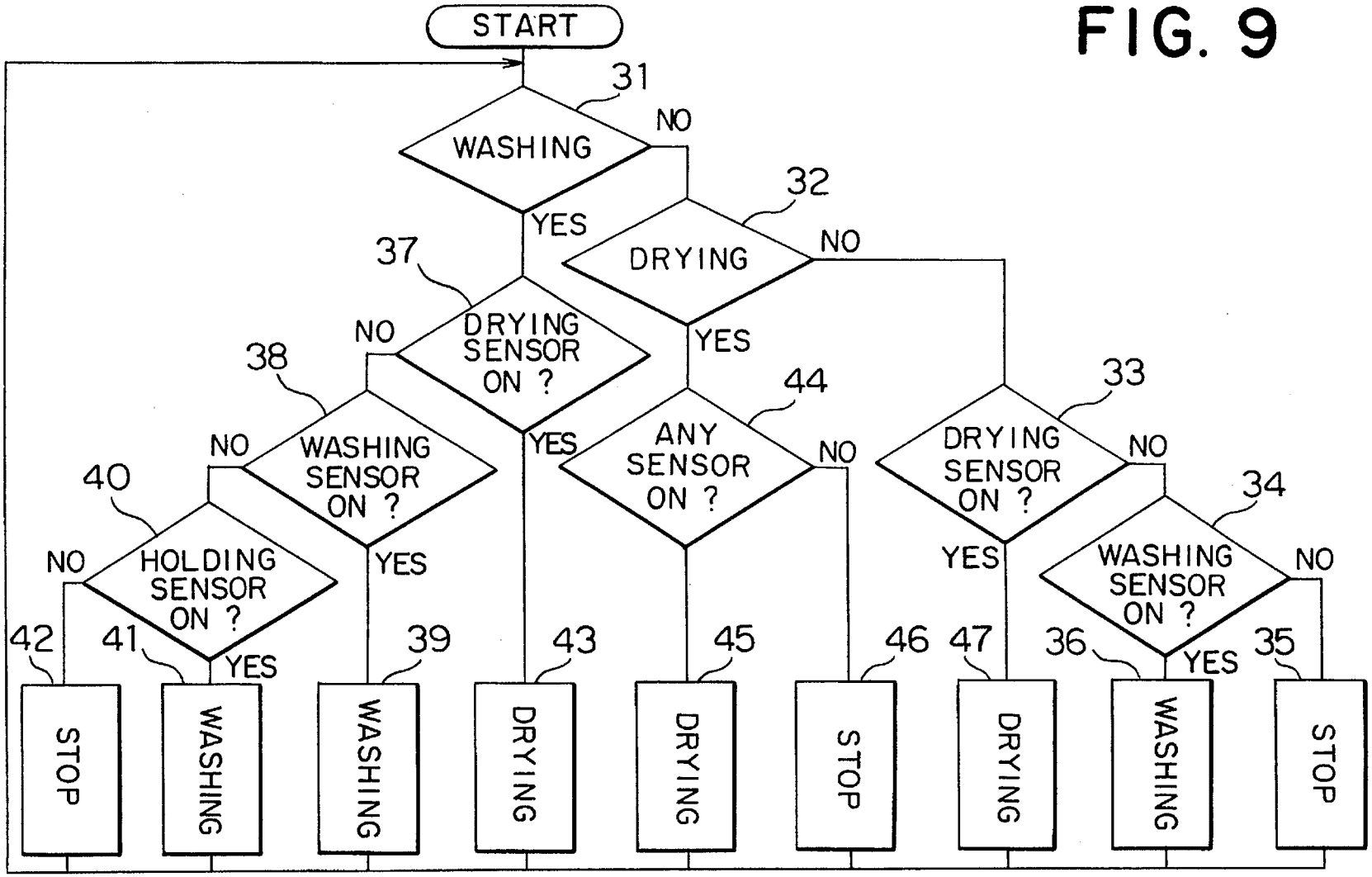
FIG. 9 is a flow-chart of washing and water removing operations according to an embodiment of the present invention.

Next, operation by each sensor will be described with reference to FIG. 9.

First, it is determined from the operating state of the pressurizing pump 19 whether washing is being effected at step 31. When the washing apparatus is not in use, the process goes to step 32 and determines from the operating state of the blower 20 whether water is being removed, and the process goes to step 33. Since neither the water drying operation sensor 16A nor the washing operation sensor 15A is turned off, the process goes from step 33 to step 35 through step 34 and the washing apparatus is stopped. Then, the process returns to step 31 and repeats the above operation.

When the user loads the tableware 10 into the washing space and the washing operation sensor 15A is turned on (even though the holding sensor 15B is turned on at first, the operation is not affected thereby), the process goes to step 36 from step 34 so that washing operation starts. Then, the process goes to step 37 from step 31 and determines whether the moisture drying operation sensor 16A is turned on or not. Since the moisture drying operation sensor 16A is turned off at this time, the process goes to step 38 and determines whether the washing operation sensor 15A is turned on or not. Since the washing operation sensor 15A is turned on at present, the process goes to step 39 and the washing operation continues.

When the tableware 10 or the like is withdrawn from the path of the washing operation sensor 15A, the washing operation sensor 15A is turned off. Then, the process goes to step 40 and determines whether either of the holding sensors 15B or 16B are turned on or not. When it is turned on, the process goes to step 41 and the washing operation continues. When both of the holding sensors 15B and 16B are turned off, the process goes to step 42 and the washing operation stops after a predetermined time.

Next, when the tableware 10 being washed is instantly moved to the drying sensor area and the water drying operation sensor 16A is turned on, the process goes to step 43 from step 37 and drying operation starts after the washing operation continues for a predetermined time. This water drying operation is continued by turning on the holding sensor 16B. After the washing operation stops, the process goes to step 32 from step 31. Then, when water is being removed, the process goes to step 44 and determines whether any one of the sensors 15A, 15B, 16A, 16B are turned on or not. When any one of them are turned on, the water removing operation continues. More specifically, even if the washing operation sensor 15A is turned on while the water removing operation is being effected, the water removing operation does not shift to the washing operation and the former operation continues. Further, even if tableware is sensed by any sensor at step 44, only the water removing operation continues as in the case in which it is sensed by the moisture drying operation sensor 16A (shown in FIG. 10). The steps 31, 32, 44 and 45 constitute the continuation of the moisture drying operation.

When the user finishes the water removing job and lifts up the tableware 10, the process goes to step 46 from step 44 and the water drying operation stops after a predetermined time. When the water drying operation sensor 16A is turned on by loading the tableware 10 at the time the washing apparatus stops, the process goes to step 47 from step 33 to start the water removing operation.

As described above, when the moisture drying operation sensor 16A is turned on while washing is being effected, a shift to the moisture drying operation is executed. Even if the washing operation sensor 15A is turned on while water is being removed, however, a shift to the washing operation is not executed. This is executed to prevent the tableware 10 or the like from being wetted even if the washing operation sensor 15A is turned on by the tableware 10 or the like from which water is being removed and dried. That is, the effort employed in restarting the moisture drying job from the beginning can be eliminated.

The washing operation sensor 15A and the holding sensor 16B are positioned at the center so that an input to them can be easily executed. Further, the holding sensor 15B is positioned at a location across which the arm of the user moves during the washing and moisture drying operations. This is for the purpose of enabling the other sensors 15A, 16B and 16A to easily sense objects to be sensed, especially small articles which are difficult to be sensed such as chopsticks. Since the moisture drying operation sensor 16A is positioned at the furthest from the user unless the sensor is intentionally turned on, it will not be energized. This location is so positioned such that when the moisture drying operation sensor 16A is turned on once, the turned-on state thereof is continued in response to an input to any one of the sensors 16B, 15A, 15B.

Figure 2:
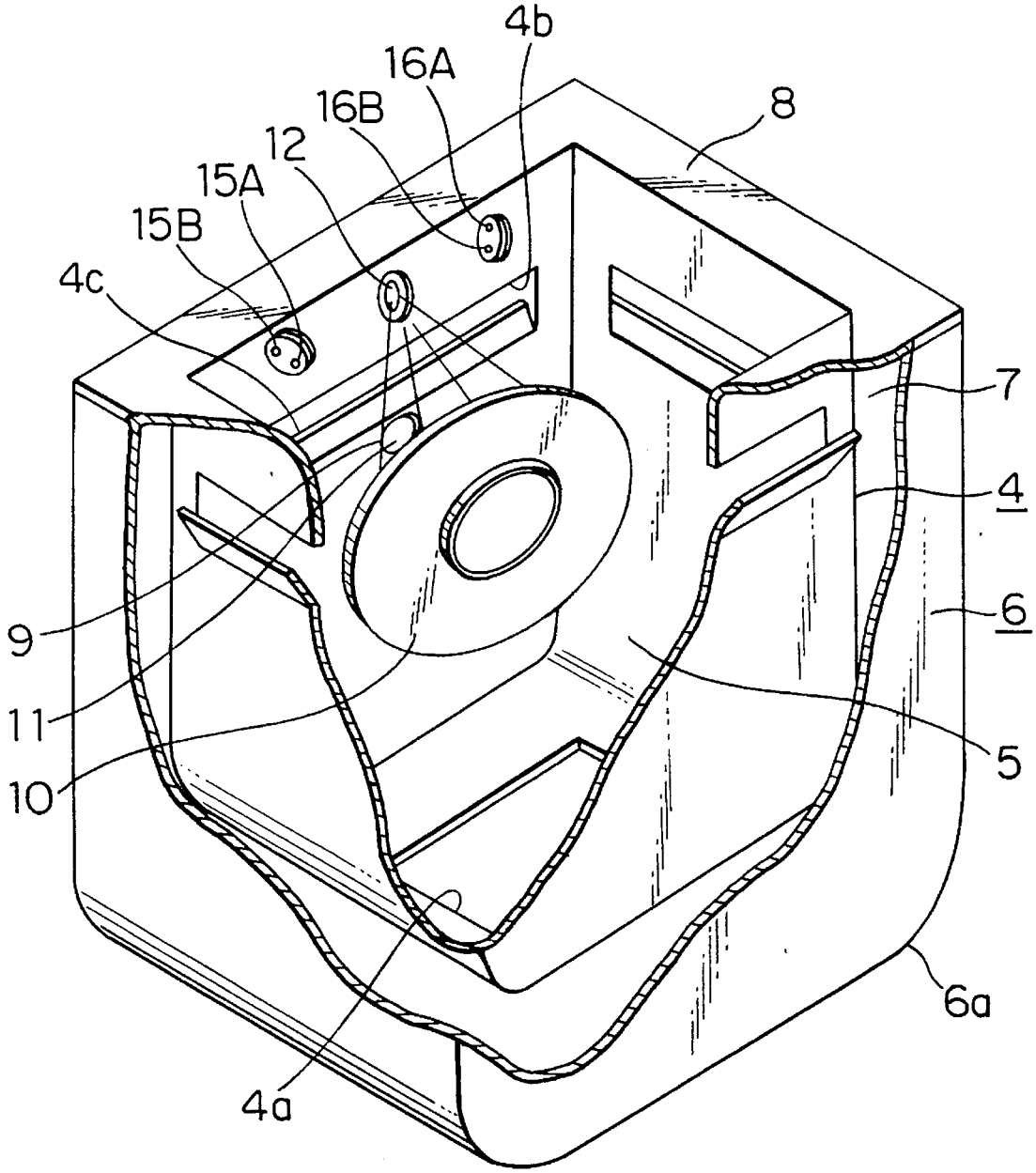
FIG. 2 is a perspective view, partly in cross section, of an inside vessel and an outside vessel of FIG. 1.
Figure 3:
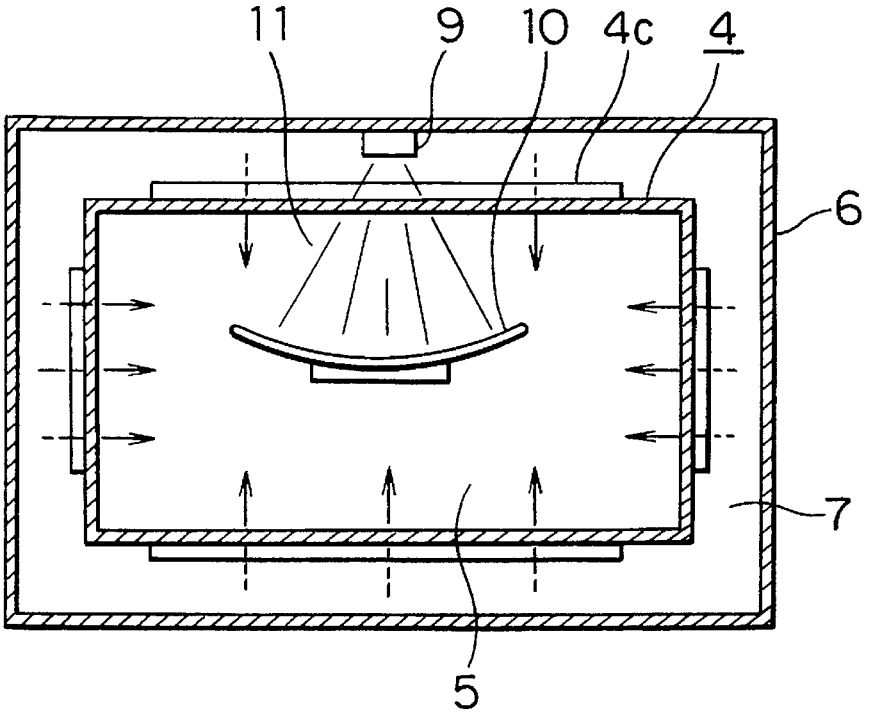
FIG. 3 is a lateral cross sectional view of FIG. 2.

As shown in FIGS. 1 and 2, since the respective sensors are fixed on the outer vessel 6 so that the sensing operation is achieved through holes defined in the inner vessel 4 and the upper portion and the circumference of the sensors are surrounded by walls, a light from the outside is difficult to affect the sensors so as to avoid the misoperation of the sensors.

It is to be noted that although two sets of the holding sensors 15B, 16B are provided, additional sensors may be provided so as to more stably effect the washing and moisture drying operation.

When the manually operated washing switch 26 is turned on, the washing operation is effected by turning on the washing mechanism 28 regardless of the content sensed by the washing operation sensor 15A. When the manually operated water removing switch 27 is turned on, the water removing operation is effected by turning on the moisture drying mechanism 29 regardless of the content sensed by the moisture drying operation sensor 16A.

That is, the washing operation and moisture drying operation can be continuously effected so that the washing apparatus can be used more conveniently when batch washing is required.

Figures 10, 11:
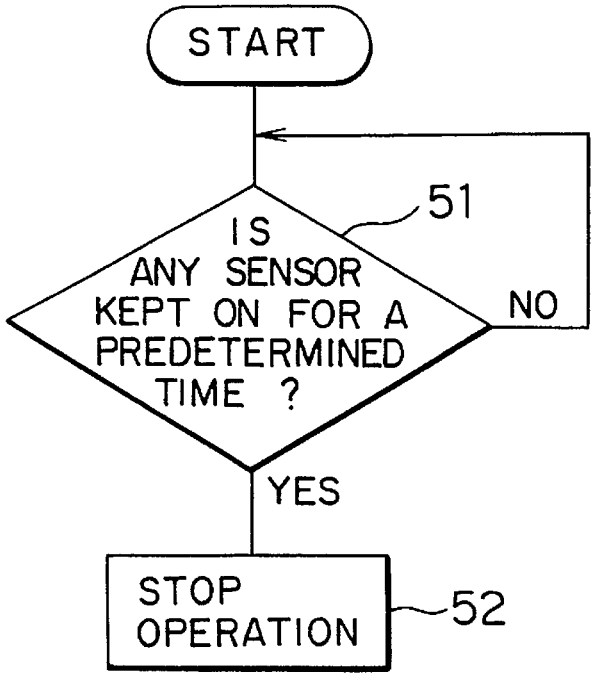
FIG. 10 is a view explaining operation when the respective sensors are turned on according to an embodiment of the present invention.
FIG. 11 is a flow chart showing sensor misoperation according to an embodiment of the present invention.

Next, misoperation of sensor preventing operation will be described with reference to FIG. 11.

It is determined at step 51 whether any one of the sensors 15A, 15B, 16A or 16B are continuously turned on longer than a set time or not. If any one of them are continuously turned on longer than the set time, the process goes to step 52 (operation preventing means) to stop the operation of the washing apparatus.

With this arrangement, when dust and the like are attached to any one of the sensors 15A, 15B, 16A, 16B or any one of the sensors 15A, 15B, 16A or 16B are covered with a portion of the inner vessel 4 because the sensor is improperly disposed to the inner vessel 4, the continuation of wasteful operation can be prevented.

As apparent from the foregoing description, in the washing apparatus of the present invention, when the user inserts the tableware or the like by hand into the opening, the washing water pressurized by the pressurizing pump is injected from the injection nozzle against the tableware or the like, so that the dirt or soil attached to the tableware or the like is removed by the impact of the injected washing water. Since the opening is kept in the open state at this time, the user can see and know the extent of achievement of the washing so that the tableware or the like can be withdrawn from the opening immediately when it is determined that the washing is completed to a sufficient extent. Thus, since the object to be washed can be washed individually without the need for any preparation, knives, chopping boards, bowls and the like which are used during cooking can be easily washed at any time when necessary. Also, coffee cups or the like can be washed quickly and individually. Also, since the tableware or the like is washed with the washing water injected at a high pressure, no detergent is necessary, so that vegetables and silverware can also be washed.

Also, since the injection of the washing water is terminated with a predetermined time lag after the non-presence of the tableware or the like is detected, when there are more than two objects to be washed, and the second object to be washed is about to be inserted into the washing space through the opening after the first object is washed and withdrawn from the washing space, the injection of the washing water is not interrupted, so that the washing continues as the second object is inserted into the washing space. Therefore, the washing time can be shortened to enable quick washing.

The washing apparatus further comprises an air nozzle for expelling air into the washing space, so that tableware or the like can be washed and dried within the common washing space, whereby the tableware or the like dried immediately after the washing can be withdrawn from the washing space through the opening to be placed directly into a cupboard or the like.

The washing apparatus is arranged such that the air nozzle comprises a plurality of air nozzles each injecting air into different directions, so that the air flow does not impinge upon the same surface of the tableware or the like, whereby drying time for the tableware or the like can be reduced by half.

The washing apparatus is also arranged such that the air nozzle includes holes for injecting air in radial directions, so that the area at which the drying takes place is increased and the water drops removed by the air are scattered in many directions, reducing the drying time for the tableware or the like.

The washing apparatus is arranged such that the air nozzle is detachably mounted, so that the cleaning of the air nozzle can be easily performed to improve the hygiene conditions. This is particularly significant in the washing apparatus of the type in which washing and drying are achieved in the single common washing space where the waste food or the like stripped from the tableware or the like by washing may stick to the inner wall of the washing tank or the like, creating a hygiene problem.

Also, since the washing apparatus comprises means for preventing the injection of washing water from the injection nozzle while the air is blasted from the air nozzle, in a washing apparatus in which the washing and cleaning is achieved within a common washing space, the moisture drying of the tableware or the like is not affected by any newly injected washing water, the washing apparatus realizing the reduction of the drying time for the tableware or the like.

Also, since the washing sensor is positioned to the front of the opening and the drying sensor is positioned on the other side of the opening, the initiation of the washing is made easier and, when the operation is being shifted to drying after washing, the drying can be initiated by simply moving the tableware or the like within the common washing space, so that the washing and drying operations can be easily carried out.

The washing apparatus comprises a plurality of injection nozzles for injecting washing water in various different directions, so that the washing function against the soiled tableware or the like extends to a wide range of the surface area of the tableware or the like and, for example, the front and reverse sides of a dish can be concurrently washed, reducing the washing time.

Also, since the lid detachably attached to the opening for opening and closing the opening is provided, the lid prevents the ingress of insects or the like into the washing space when the washing apparatus is not in use and the lid may be utilized as a working surface for cooking. Also, since the lid is detachable, the lid may be detached from the opening when the washing operation is to be achieved thereby to enlarge the working surface for washing.

The washing apparatus of the present invention also comprises an outer vessel and an inner vessel defining a space therebetween, so that the washing water impinged upon the tableware or the like and atomized by the impact is introduced into the space defined between the washing vessel and the inner vessel to be attached on their wall surfaces, whereby the atomized washing water can be prevented from flowing out to the outside of the opening.

Also, since the washing apparatus comprises a fin inwardly projecting from the inner surface of the inner tank, the atomized washing water generated by impinging upon the tableware or the like is prevented from flowing out toward the opening by the diverging action of the fin, preventing the washing water from splashing onto the user.

Also, the washing apparatus further comprises an auxiliary water injection nozzle disposed above the water injection nozzle for injecting water at a pressure lower than that of the water injected from the water injection nozzle, so that the washing water injected from the injection nozzle against the tableware or the like and scattering is prevented from flowing out by a curtain of the washing water injected from the auxiliary nozzle at a less higher pressure, whereby the atomized washing water can be prevented from splashing onto the user.

Figure 13:
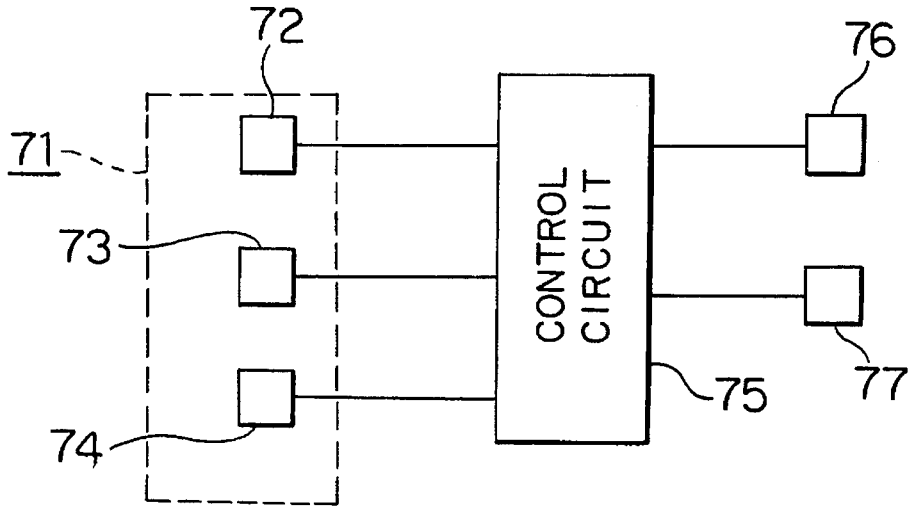
FIG. 13 is a block diagram of the washing apparatus.

FIG. 13 is a block diagram of another embodiment of the washing apparatus of the present invention, in which the pressurizing pump is started and stopped after the tableware or the like is detected. While, in the previous embodiment, the washing water 11 is stopped after a lapse of a predetermined time by the holding sensor 15B, in this embodiment, the washing water 11 is kept injected for a predetermined time without using the holding sensor 15B.

Reference numeral 71 denotes the sensing means composed of the object to be washed sensing means 72 disposed opposite to the inside wall of the opening 2 of the main body 1, remaining food sensing means 73, drain clogging sensing means 74. Each of the sensing means 72, 73 and 74 are composed of, for example, light emitting diodes having a light emitting side and a light receiving side and sensing operation is effected by the transmission and reflection of light. The object to be washed sensing means 72 is connected to a pressurizing pump control means 76 through a control circuit 75, and the remaining food sensing means 73 and the drain clogging sensing means 74 are connected to warning means 77 through the control circuit 75.

Figure 14:
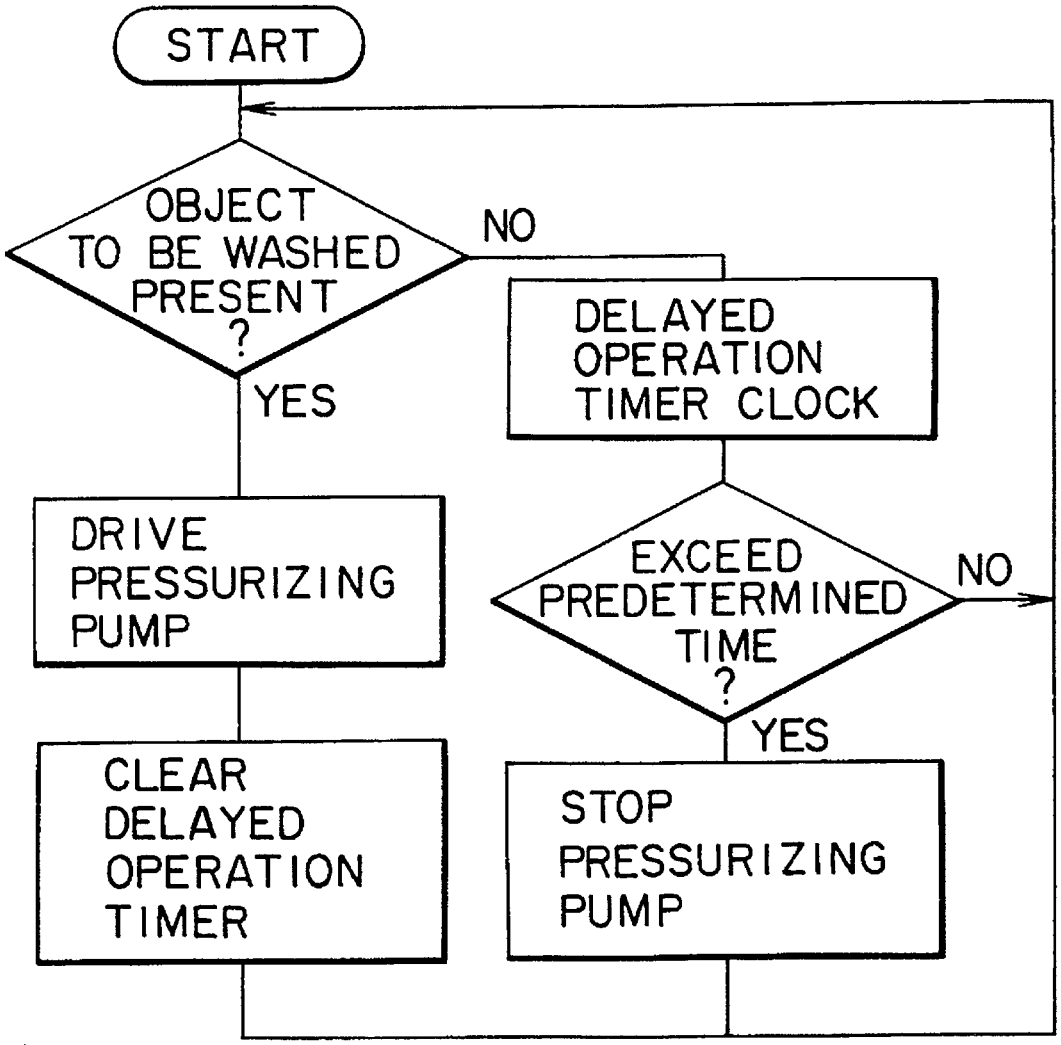
FIG. 14 is a flow chart explaining the operation of the control circuit shown in FIG. 13.

FIG. 14 is a flow chart illustrating the operation of the control circuit 75 for controlling the pressurizing pump 19. When the tableware 10 or the like are entered into the washing space 5, the presence of the tableware 10 or the like is sensed by the object to be washed sensing means 72 so that the washing water pressurizing pump 19 is automatically operated by the pressurizing pump control means 72. Thereafter, when the tableware 10 or the like are taken out from the washing space 5, they are sensed by the object to be washed sensing means 72 that there are no tableware 10 or the like, so that the washing water pressurizing pump 19 is automatically stopped by the pressurizing pump control means 76. As a result, utilities such as electricity, water and the like can be saved and operation can be simplified. Further, when the tableware 10 or the like are taken out from the washing space 5, they are sensed by the object to be washed sensing means 72 that there are no tableware 10 or the like and the predetermined time measuring means starts to register the time. When the presence of the tableware 10 or the like is not sensed again by the object to be washed sensing means 72 within a predetermined time, energy can be saved and restart responsiveness can be maintained by that the washing water pressurizing pump 19 is stopped by the pressurizing pump control means 76.

Figure 16:
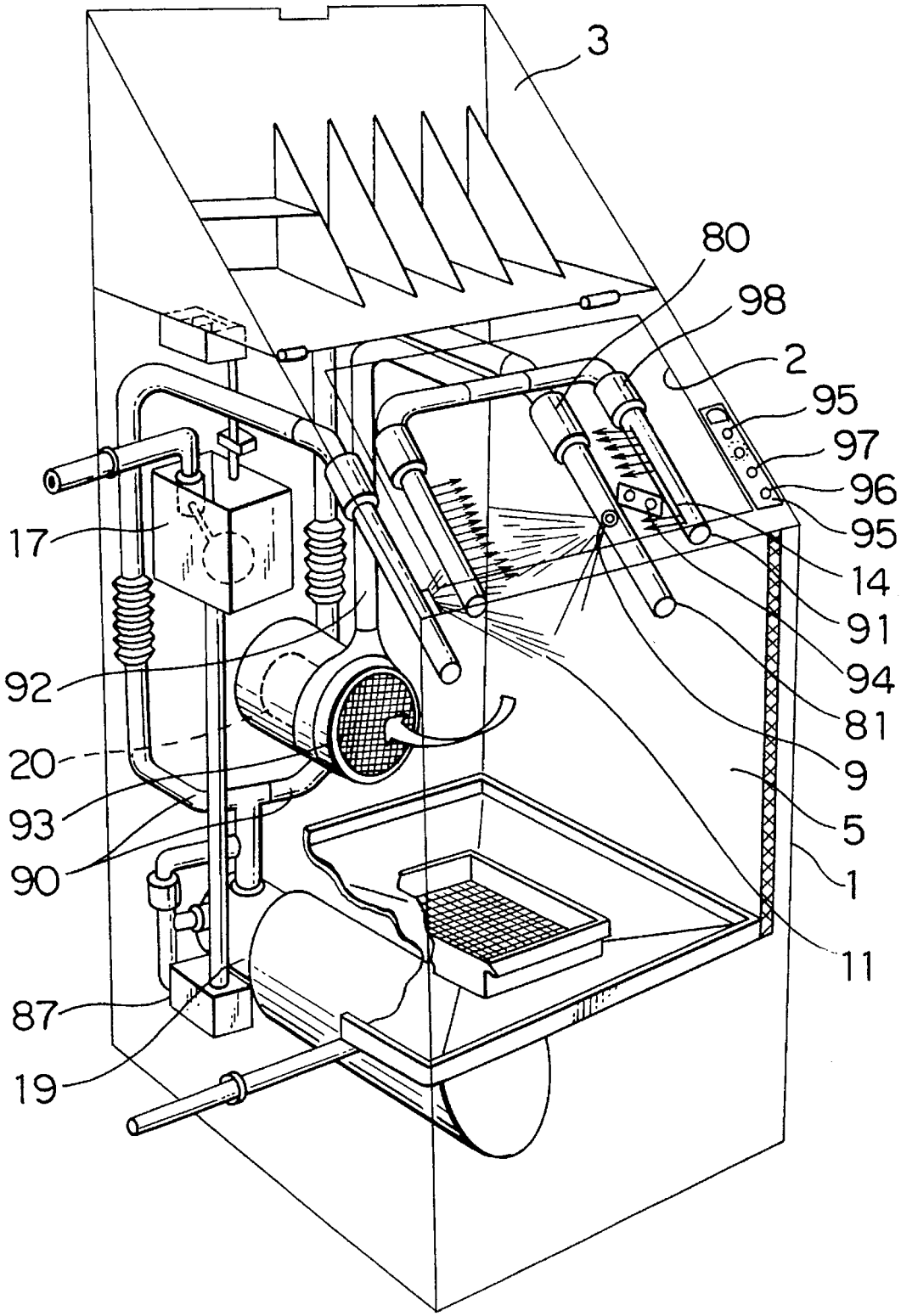
FIG. 16 is a schematic perspective view of another embodiment of the washing apparatus of the present invention.

FIG. 16 is a schematic perspective view of the washing apparatus of still another embodiment of the present invention and, in FIG. 16, the same reference numerals designate corresponding or identical components those illustrated and explained in conjunction with other previous embodiments.

In this embodiment, the washing apparatus comprises the box-shaped main body 1 having the rectangular opening 2 at the front upper corner of the main body 1, the opening 2 being slanted to open toward the front upper side. The main body 1 comprises therein two-opposing main nozzles 9 for injecting the washing water 11, the nozzles being disposed at the upper portion of the main body 1 in an opposing relationship to inject the washing water 11 simultaneously from both nozzles 9. The main nozzles 9 are disposed at the nozzle pipes 81, being connected to the nozzle rotating mechanism 80 (see FIG. 17). The nozzle pipes 81 are connected respectively to two prongs of the forked pipe 90 connected to the pressurizing pump 19 disposed at the bottom of the main body 1. The pressurizing pump 19 is connected to the reservoir tank 17 which provides the source of water.

The air nozzles 14 provided above the nozzle pipes 81 are in the form of narrow slits formed in the pipes 91 and are connected to the blower 20. The blower 20 takes air thereinto from the washing space 5 through the air in-take 93 and supplies the air through the pipe 92 and the pipes 91 to expel it from the air nozzles 14 so that the air is circulated within the washing space 5.

The injections of washing water 11 from the washing nozzles 9 and the air from the air nozzles 14 are manually operated by the operation of the operating switch 95. That is, the washing switch 96 is actuated to control the injection and stoppage of the washing water 11 and, similarly, the air switch 97 is actuated to control the blasting and stoppage of the air flow from the air nozzles 14.

Reference numeral 94 designates a sensor for actuating the pressurizing pump 19 and the blower 20 for a predetermined time when the tableware 10 or the like is detected within the washing space 5, the sensor 94 being actuated when an automatic operation is conducted. Shift between the automatic operation and the manual operation is achieved by the operation switch 95.

In the automatic operation of the washing apparatus of this embodiment, when the tableware 10 or the like is inserted from the opening 2, the sensor 94 detects it to drive the pressurizing pump 19 which injects the high-pressure washing water described in conjunction with the first embodiment from the washing nozzles 9 to separate and wash away the dirt or soil attached to the tableware 10 or the like. Since the air flow is expelled from the air nozzles 14 at the same time and since the force of the air flow directed at the moisture on the table ware 10 or the like is greater than the surface tension or the adhesion force of the moisture on the tableware 10 or the like, when the tableware 10 or the like is gradually withdrawn toward the opening 2, the moisture on the tableware 10 or the like is blasted off and dried, whereby the tableware 10 or the like is taken out dried.

At this time, since the main nozzles 9 inject washing water 11 against the front and reverse sides of the tableware 10 or the like, the washing time for the tableware 10 or the like can be reduced by half. Also, since air nozzles 14 direct air against the front and reverse sides of the tableware 10 or the like, the drying time for the tableware 10 can be reduced by half. Thus, the time needed for washing and drying can be reduced.

Also, since the air nozzles 14 are positioned above the main nozzles 9, the mist or the water drops generated during the washing of the tableware 10 or the like within the washing space 5 is prevented by the air expelled from the air nozzles 14 from splashing on the user outside of the opening 2. During the manual operation, the driving and the stopping of the pressurizing pump 19 and the blower 20 are achieved by the respective operation of the washing switch 96 and the air switch 97 for the respective operations, so that the washing operation only or the drying operation only can be selectively achieved.

Figure 17:
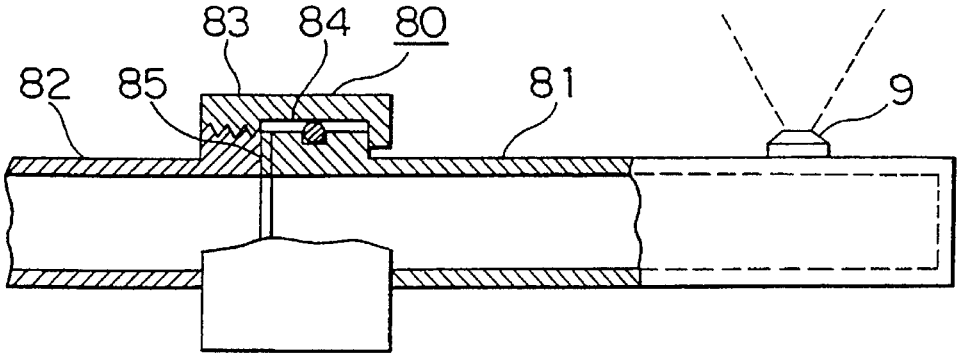
FIG. 17 is an enlarged sectional view illustrating the nozzle rotating mechanism.
Figure 18:
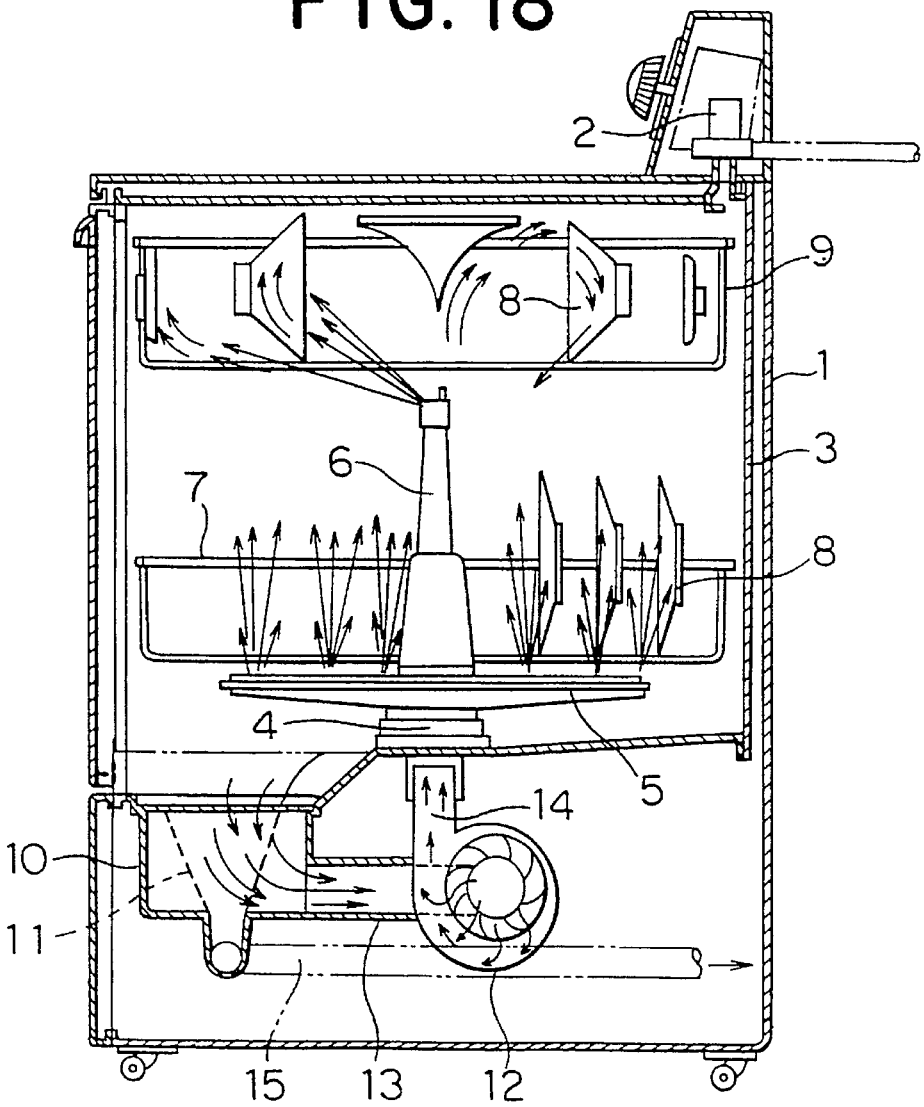
FIG. 18 is a front sectional view illustrating the conventional washing apparatus.

FIG. 17 illustrates means for changing the angle of the main nozzles 9. Reference numeral 80 designates a nozzle rotation mechanism for rotating the nozzle pipe 81 connected to the pressurizing pump 19 about its axis and comprises a flange nut 83 thread-engaged on the end portion of the manifold pipe 82, an O-ring 84 fitted over the end portion of the nozzle pipe 81 and a packing 85 inserted between the end portions of the upper stream-side manifold pipe 82 and the nozzle pipe 81.

Therefore, the angle adjustment can be easily achieved by tightening the flanged nut 83 after the angle of the injected washing water 11 is set at a desired state.

It is to be noted that a generally used angle adjusting means such as a joint for allowing the movement of the main nozzle alone may be equally used.

Reference numeral 98 is a nozzle rotation mechanism of the structure identical to the nozzle rotation mechanism 80 and allows the air nozzles 14 to suitably change its air expelling angle.

Also, reference numeral 87 is a heater disposed at the bottom portion of the interior of the main body 1 and connected to the water tank 17 or the source of water for heating the washing water 11. The heater 87 may be a generally used heater for heating the washing water 11 which is injected from the main nozzles 9, so that the user is prevented from feeling cold during the winter season. The heater 87 may be connected between the pressurizing pump 19 and the pipe 90. Therefore, when a temperature adjusting means for changing the washing water temperature is provided, the washing water injected from the injection nozzles can be made to be hot water so that the pollution on the tableware or the like may be easily removed. When the object to be washed is a vegetable or the like, the washing water can be made cold so that the food may not be damaged. Also, since the temperature changing means is provided between the water source such as the water tank and the injection nozzle, the heat is not wasted and the necessary heat is minimized with the effect of the washing capability being improved.

In this embodiment, the pressure of the washing water 11 injected from the main nozzles 9 can be easily adjusted by the control of the revolution per minute of the pressurizing pump 19. Also, the water pressure injected from the main nozzles 9 which are disposed at two horizontally separated sides of the main body 1 may preferably be made different from one another by means of an orifice 99 illustrated in FIG. 15. This is because dishes, for example, are usually soiled only on one side with the other side being almost clean and there is no need for the main nozzles 9 to inject the washing water 11 at the same pressure and waste the washing water injected on the other side. Therefore, through the use of the orifice 99, such waste of the washing water 11 can be eliminated. Thus, with the provision of the adjusting means for changing the water pressure or the water injection angle, an optimum washing capability tailored in accordance with the size of the tableware or the like and the extent of the soiling, realizing a washing apparatus easy for the users to use.

What is claimed is:

1. A washing apparatus comprising:

a main body having an opening provided in the upper portion thereof for allowing an object to be washed to be moved therethrough into and out of said main body;

an outer vessel defining therein a washing space communicated with said opening;

an inner vessel disposed within said outer vessel with a space formed therebetween and said inner vessel having at a bottom wall thereof an opening communicated with said space between said inner and outer vessels;

first means for injecting clean water, without detergent, at a high pressure into said washing space, disposed in said inner or outer vessel;

second means for injecting water at a pressure lower than that of the water injected from said first water injection means, disposed above said first water injection means;

means for pressurizing clean water connected to said first water injection means; and a source of clean water for supplying clean water, without detergent to said water pressurizing means.

2. A washing apparatus as claimed in claim 1, further comprising an air injection nozzle for blowing drying air into said washing space and a pressurized air supply means for supplying drying air to said air injection nozzle.

3. A washing apparatus as claimed in claim 2, wherein said air injection nozzle comprises a plurality of injection nozzles each injecting air into different directions.

4. A washing apparatus as claimed in claim 2, wherein said air injection nozzle includes holes for injecting air in radial directions to said air injection nozzle.

5. A washing apparatus as claimed in claim 2, wherein said air injection nozzle is detachably mounted to said outer vessel.

6. A washing apparatus as claimed in claim 2, further comprising locking means for preventing water from being injected from said water injection nozzle when air flow is generated from said air injection nozzle.

7. A washing apparatus comprising:

a main body having an opening provided in the upper portion thereof for allowing an object to be washed to be moved therethrough into and out of said main body;

an outer vessel defining therein a washing space communicated with said opening;

an inner vessel disposed within said outer vessel with a space formed therebetween and said inner vessel having at a bottom wall thereof an opening communicated with said space between said inner and outer vessels;

a longitudinal fin projecting downward and inward from the inner surface of said inner vessel, so as to prevent splashing of water out of said washing space;

first means for injecting clean water, without detergent, at a high pressure into said washing space, disposed in said inner or outer vessel;

means for pressurizing clean water connected to said first water injection means; and a source of clean water for supplying clean water, without detergent to said water pressurizing means.

8. A washing apparatus comprising:

a main body defining therein a washing space, a main body opening provided in said main body in communication with said washing space for moving therethrough an object to be washed into and out of said washing space;

first means for injecting clean water, without detergent, at a high pressure into said washing space;

second means for injecting water at a pressure lower than that of the water injected from said first water injection means, disposed above said first water injection means;

means for pressurizing clean water connected to both of said water injection means; and a water source connected to said water pressurizing means, for supplying clean water, without detergent, to said water pressurizing means.

9. A washing apparatus as claimed in claim 8, further comprising means, connected between said water source and said first water injection means, for changing temperature of the water.

10. A washing apparatus as claimed in claim 8, further comprising means for adjusting an injection angle or pressure of water injected through the water injection means.

11. A washing apparatus as claimed in claim 8, further comprising an air injection nozzle for blowing drying air into said washing space and a pressurized air supply means for supplying drying air to said air injection nozzle.

12. A washing apparatus as claimed in claim 11, wherein said air injection nozzle comprises a plurality of air injection nozzles each injecting air into different directions.

13. A washing apparatus as claimed in claim 11, wherein said air injection nozzle includes holes for injecting air in radial directions to said air injection nozzle.

14. A washing apparatus as claimed in claim 11, wherein said air nozzle is detachably mounted to said air supply means.

15. A washing apparatus as claimed in claim 11, further comprising locking means for preventing water from being injected from said water injection means when air flow is generated from said air injection nozzle.

16. A washing apparatus as claimed in claim 8, further comprising a washing sensor for detecting the object to be washed presented within said washing space to inject fresh water from said water injection nozzle and a drying sensor for detecting the object to be washed presented within said washing space to generate a flow of drying air from the air injection nozzle, said washing sensor being positioned in front of said opening and said drying sensor being positioned at a point in said opening remote from said washing sensor.

17. A washing apparatus as claimed in claim 8, said water injection means comprises a plurality of injection nozzles each injecting fresh water in different directions.

18. A washing apparatus as claimed in claim 8, further comprising a lid cover detachably mounted to said main body for opening and closing said opening.

19. The washing apparatus according to claim 8, further comprising sensor means for initiating the injection of water from said first water injection means when the object to be washed is detected, and for terminating the injection of water from said first water injection means after a predetermined time lag from the detection of the absence of the object to be washed.

20. A washing apparatus comprising:

a main body defining therein a washing space;

a main body opening provided in said main body in communication with said washing space for moving therethrough an object to be washed into and out of said washing space;

a water injection nozzle for injecting fresh water into said washing space;

a water pressurizing pump connected to said water injection nozzle for pressurizing fresh water;

a water source connected to said water pressurizing pump, for supplying fresh water to said pressurizing pump;

an air injection nozzle for injecting drying air into said washing space;

an air supply for supplying pressurized drying air to said second injection nozzle through air supply means;

a washing sensor for detecting the object to be washed presented within said washing space to inject fresh water from said water injection nozzle; and a drying sensor for detecting the object to be washed presented within said washing space to generate a flow of air from said air injection nozzle;

wherein, upon activation of said washing sensor, fresh water is injected into said washing space with said main body opening opened, and upon activation of said drying sensor, a flow of drying air is injected into said washing space.

21. A washing apparatus as claimed in claim 20, further comprising means, connected between said water source and said water injection nozzle, for changing temperature of the water.

22. A washing apparatus as claimed in claim 20, further comprising means for adjusting an injection angle or pressure of water injected through said water injection nozzle.

23. A washing apparatus as claimed in claim 20, wherein said air injection nozzle comprises a plurality of injection nozzles each injecting air into different directions.

24. A washing apparatus as claimed in claim 20, wherein said air injection nozzle includes holes for injecting air in radial directions to said air injection nozzle.

25. A washing apparatus as claimed in claim 20, wherein said air injection nozzle is detachably mounted to said air supply means.

26. A washing apparatus as claimed in claim 20, further comprising locking means for preventing water from being injected from said water injection nozzle when air flow is generated from said air injection nozzle.

27. A washing apparatus as claimed in claim 20, wherein said water injection nozzle comprises a plurality of injection nozzles each injecting water in different directions.

28. A washing apparatus as claimed in claim 20, further comprising an auxiliary water injection nozzle disposed above said water injection nozzle for injecting water at a pressure lower than that of the water injected from said water injection nozzle.

* * * * *